US006390778B1

(12) United States Patent
Lee

(10) Patent No.: US 6,390,778 B1
(45) Date of Patent: May 21, 2002

(54) CEILING FAN BLADE

(76) Inventor: Ching-Tan Lee, No. 52, Lane 480, Section 2, Fenghsi Rd., Taichung Hsien (TW)

( * ) Notice: Subject to any disclaimer, the term of this patent is extended or adjusted under 35 U.S.C. 154(b) by 0 days.

(21) Appl. No.: 09/781,258

(22) Filed: Feb. 13, 2001

(51) Int. Cl.[7] ..... H04D 29/34
(52) U.S. Cl. ..... 416/210 R
(58) Field of Search ..... 416/204 R, 210 R, 416/214 R, 215, 216, 219 R, 219 A

(56) References Cited

U.S. PATENT DOCUMENTS 578,846 A * 3/1897 Wiedemann ..... 416/244 R
1,263,909 A * 4/1918 London et al. ..... 416/210 R
3,694,104 A * 9/1972 Erwin ..... 416/217
D309,183 S * 7/1990 Taylor, III ..... 416/206 X
D325,778 S * 4/1992 Taylor, III ..... 416/5 X
5,110,261 A * 5/1992 Junkin ..... 416/204 R
5,338,156 A * 8/1994 Chien ..... 416/214 R X
5,462,407 A * 10/1995 Calvo ..... 416/132 A
5,601,409 A * 2/1997 Huang ..... 416/229 A
5,795,131 A * 8/1998 Crowhurst et al. ..... 416/146 R

* cited by examiner

*Primary Examiner*—John E. Ryznic
(74) *Attorney, Agent, or Firm*—Rosenberg, Klein & Lee

(57) ABSTRACT

A ceiling fan blade assembly includes a U-shaped frame with a groove in an inner periphery of the frame and a plurality of connection members are received in the grooves. A blade body is connected to the connection members and enclosed by the frame.

6 Claims, 6 Drawing Sheets

CEILING FAN BLADE

FIELD OF THE INVENTION

The present invention relates to a ceiling fan blade which includes a frame with connection members connected to an inner periphery thereof and a blade body is connected to the connection members.

BACKGROUND OF THE INVENTION

A conventional ceiling fan generally includes a motor and a plurality of blade brackets are connected to an output shaft of the motor. Each blade bracket is connected with a blade. The blades are made of hard material such as wood or metal so that they are heavy and not easily to put decoration or patterns thereon. Because of the heavy weight of the blades, the momentum is large so that the connection between the blade frame and the blade is required to be strong enough to overcome the eccentric force applied to the connection portions. The motor also has to be powerful to rotate the fan blades at different speed. The limitations make the manufacturers give up the use of light material such as fabric.

The present invention intends to provide a ceiling fan blade structure that includes an elongate frame and a blade body which is connected to an inner periphery of the frame by connection members.

SUMMARY OF THE INVENTION

In accordance with one aspect of the present invention, there is provided a ceiling fan blade assembly and comprising a U-shaped frame having a groove defined in an inner periphery of the frame. A plurality of connection members each comprise an engaging portion and an insertion which is connected to the engaging portion and received in the groove. A first secure member is connected to the engaging portion. A blade body has a plurality of second secure members which are securely connected to the first secure members.

The primary object of the present invention is to provide a ceiling fan blade assembly that has a frame and a blade body made of soft material is connected to an inner periphery of the frame by connection members connected between the frame and the blade body. The blade body is easily connect to and disconnected from the frame.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
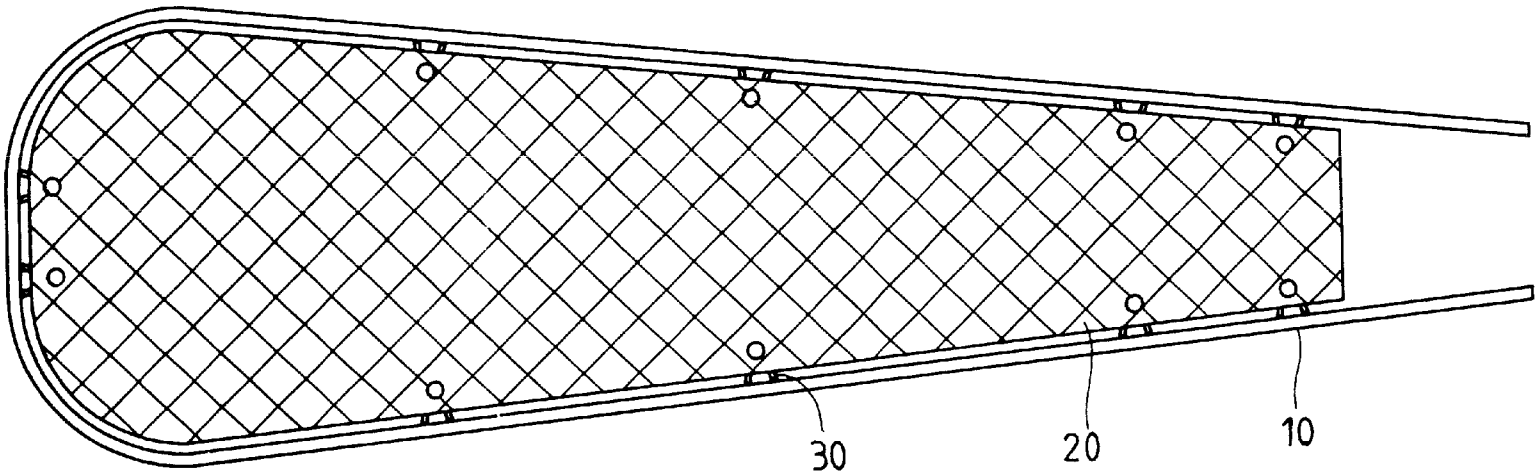
FIG. 1 is a plan view to show a ceiling fan blade assembly of the present invention.
Figure 2:
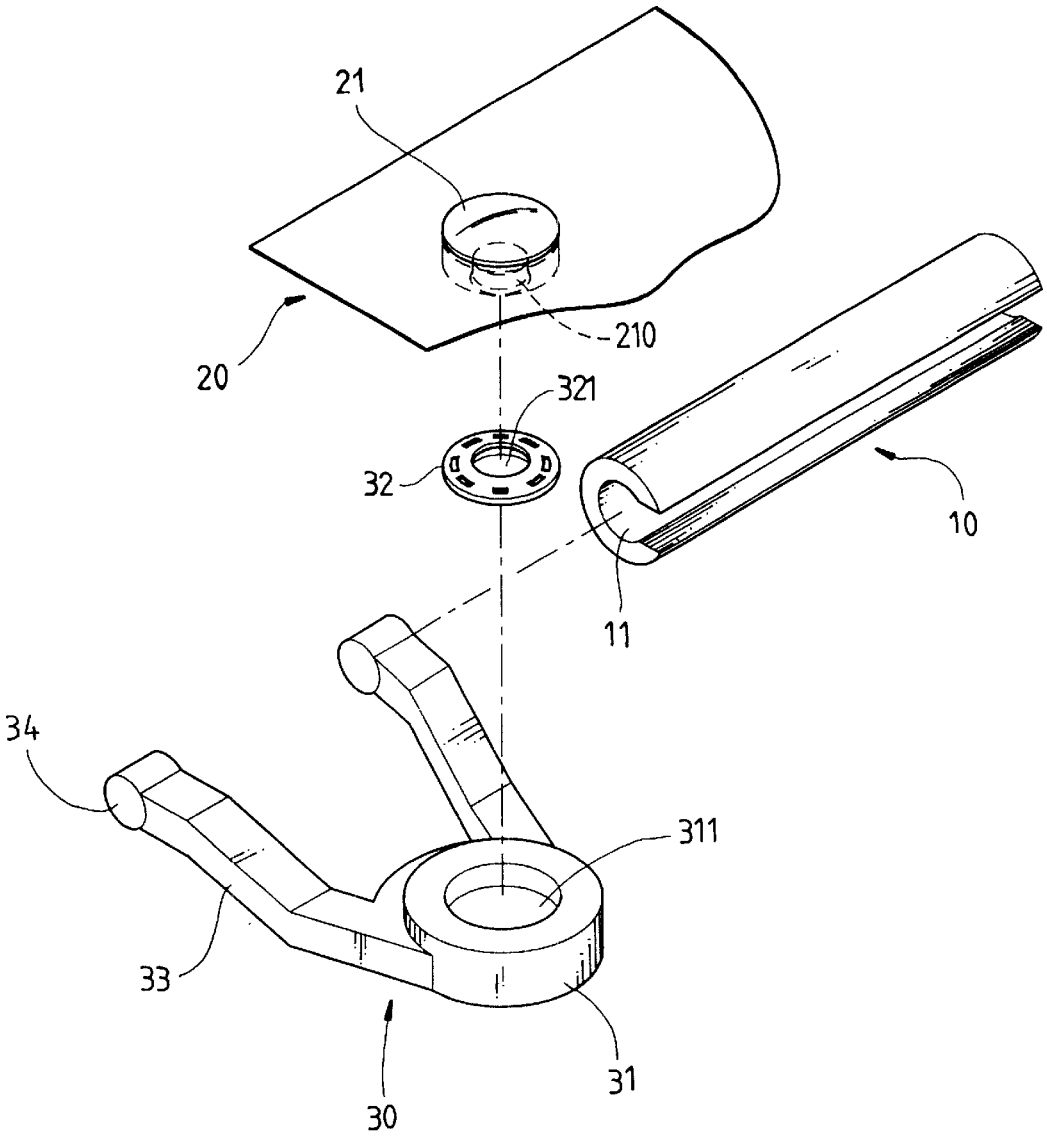
FIG. 2 is an exploded view to show ceiling fan blade assembly of the present invention.
Figure 3:
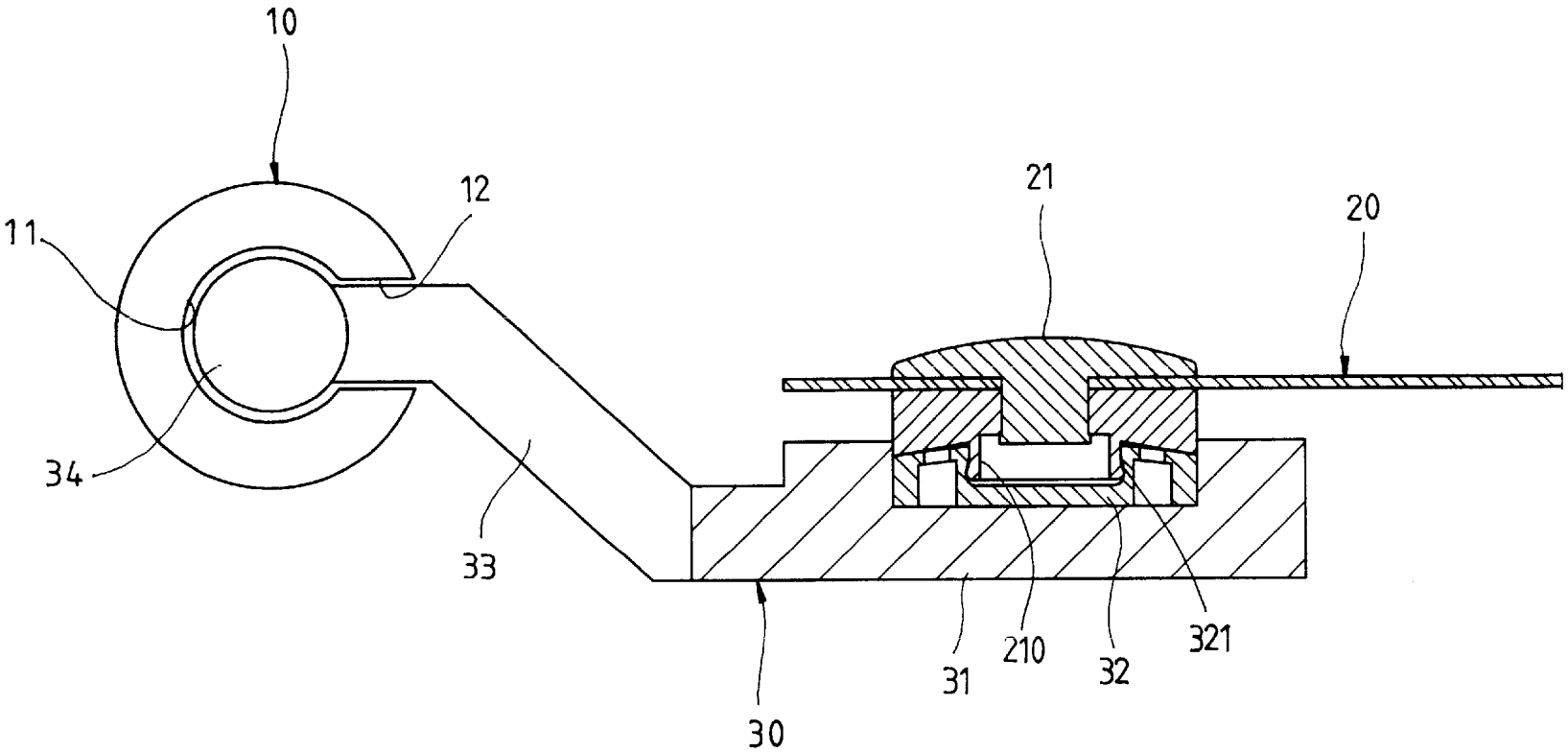
FIG. 3 is a cross sectional view to show ceiling fan blade assembly of the present invention.

Referring to FIGS. 1 to 3, the ceiling fan blade assembly of the present invention comprises a U-shaped frame 10 and a groove 11 is defined in an inner periphery of the frame 10. A plurality of connection members 30 each comprise an engaging portion 31 and two legs 33 which extend from each of the engaging portions 31 at a desired angle. Two cylindrical insertions 34 are connected to the two legs 33 so as to be received in the groove 11 of the frame 10. Each of the engaging portions 31 has a recess 311 defined therein and a first secure member 32 is received in each of the recesses 311. The first secure member 32 has an engaging recess 321.

A blade body 20 has a plurality of second secure members 21 connected thereto and the second secure members 21 each have a protrusion 210 which is engaged with the engaging recess 311 of the first secure member 32 in the engaging portions 31. The blade body 20 can be made of soft material such as fabric or plastic sheet. The first secure member 32 and the second secure member 32 can be easily snapped together by pressing the protrusion 210 into the engaging recess 321.

Figure 4:
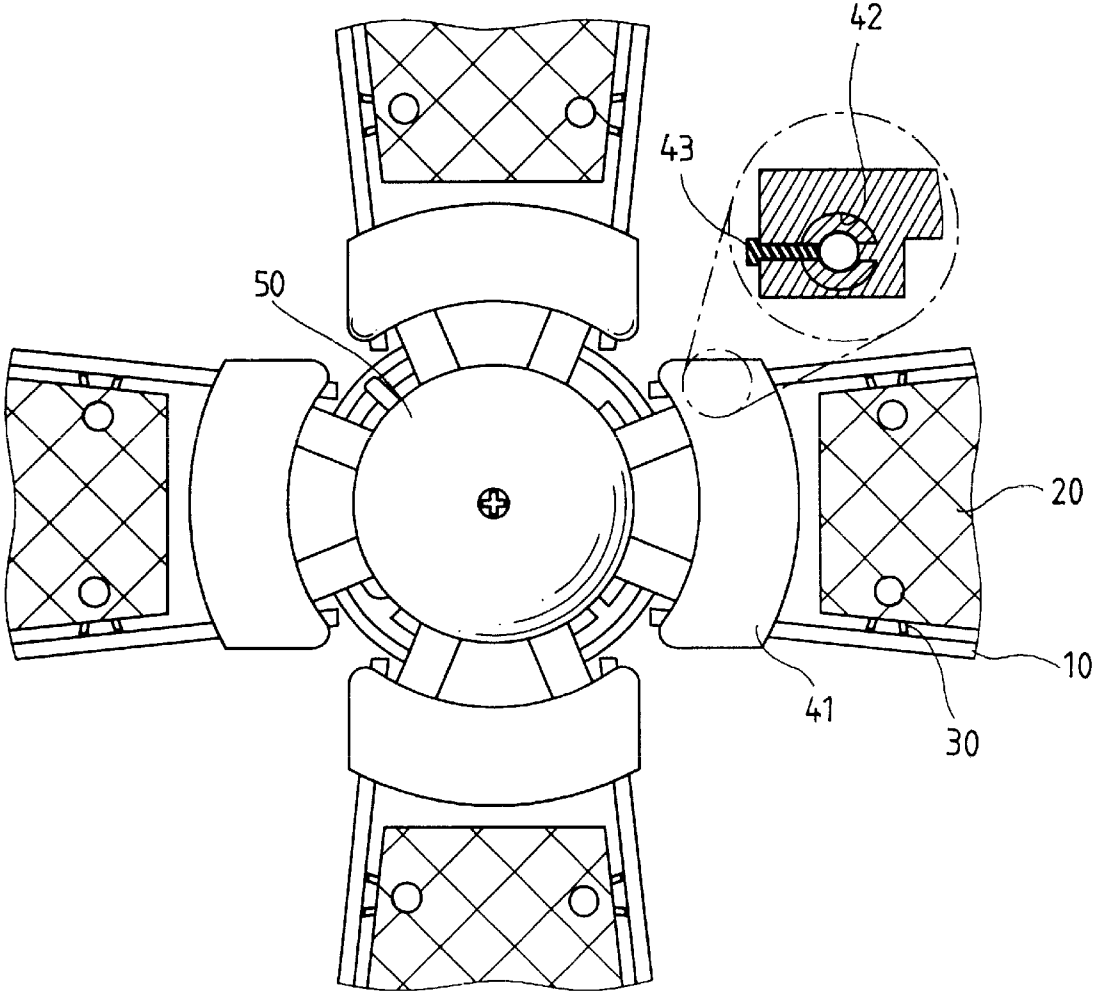
FIG. 4 shows that the ceiling fan blade assembly of the present invention is connected to a blade bracket of a ceiling fan.
Figure 5:
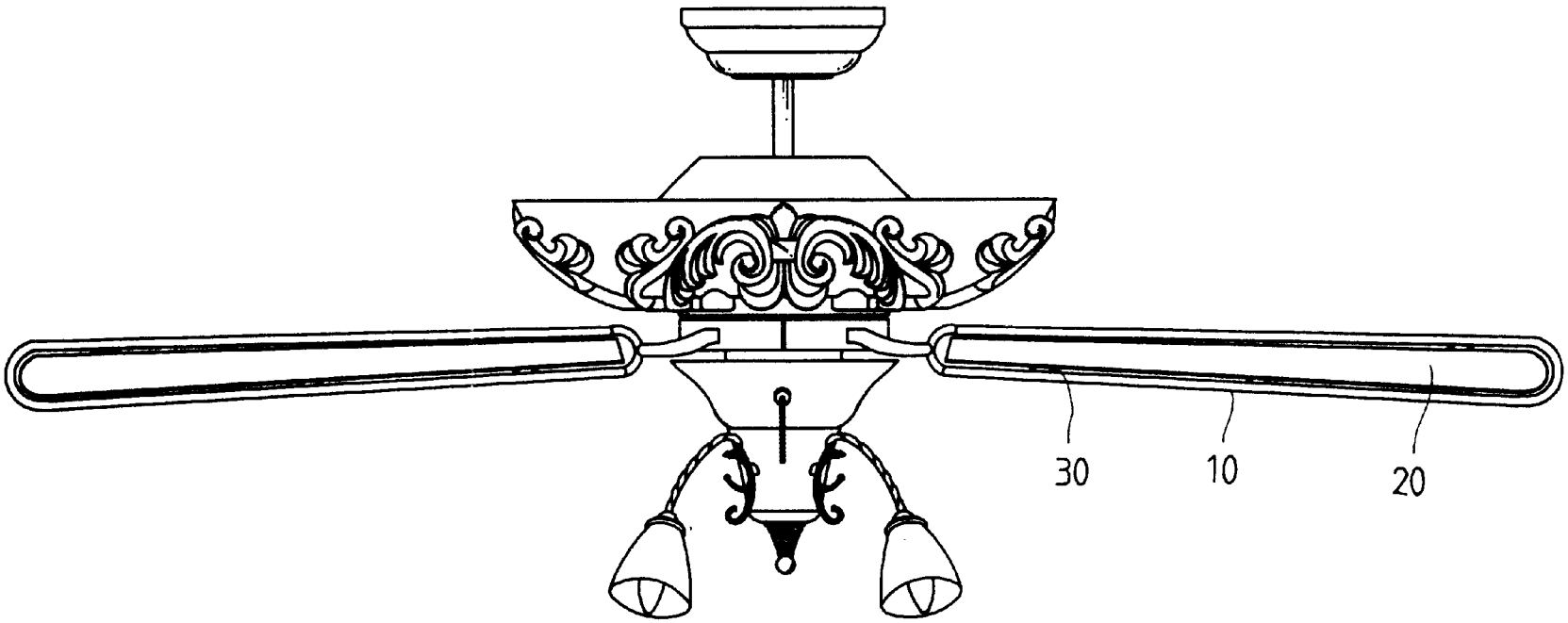
FIG. 5 shows that the ceiling fan blade assembly of the present invention has an elongate frame.
Figure 6:
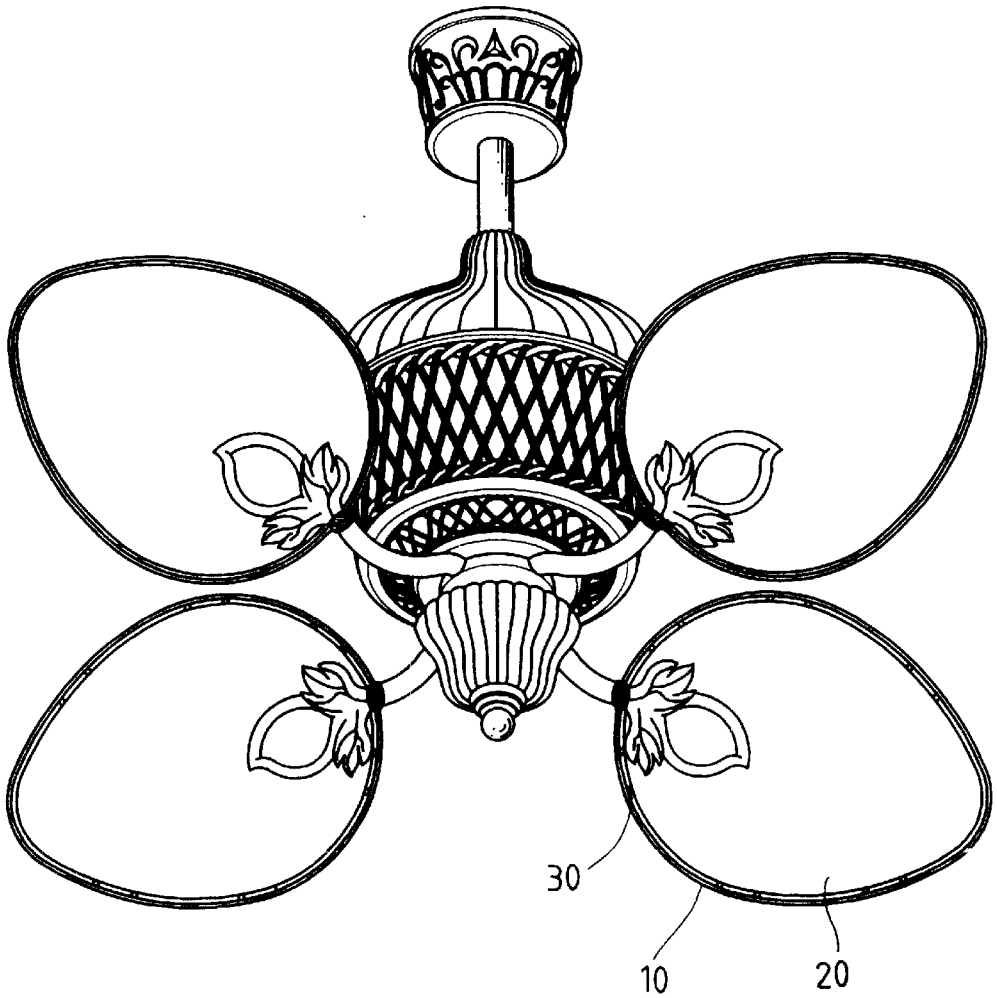
FIG. 6 shows that the ceiling fan blade assembly of the present invention as a leaf-shaped frame.

FIG. 4 shows that a ceiling fan includes four blade brackets 41 which are connected to a motor 50 of the ceiling fan and the blade brackets 41 each have two holes 42 so as to receive two distal ends of the U-shaped frame 10. A bolt 43 extends through the blade bracket 41 and contacts the frame 10 to position the frame 10. FIGS. 5 and 6 respective show that the shape of the frame 10 can be an elongate frame or a leaf-shaped frame.

The connection between the blade body 20 and the frame 10 allows the manufacturers to design various shapes of the frame 10 and the material that the blade body 20 is made may also be chosen from various type of materials.

While we have shown and described various embodiments in accordance with the present invention, it should be clear to those skilled in the art that further embodiments may be made without departing from the scope of the present invention.

What is claimed is:

1. A ceiling fan blade assembly comprising:

a U-shaped frame and a groove defined in an inner periphery of said frame;

a plurality of connection members each comprising an engaging portion and an insertion which extends from said engaging portion and is received in said groove in said frame, a first secure member connected to each of said engaging portions, and a blade body having a plurality of second secure members which are securely connected to said first secure members.

2. The ceiling fan blade assembly as claimed in claim 1 further comprising two legs extending from each of said engaging portions and said insertion being a cylindrical part connected to each of said two legs.

3. The ceiling fan blade assembly as claimed in claim 1 wherein each of said engaging portions has a recess defined therein and said first secure member is received in said recess.

4. The ceiling fan blade assembly as claimed in claim 3 wherein said first secure member has an engaging recess and said second secure member has a protrusion which is engaged with said engaging recess.

5. The ceiling fan blade assembly as claimed in claim 1 further comprising a blade bracket adapted to be connected to the motor of the ceiling fan and said blade bracket having two holes so as to receive two distal ends of said U-shaped frame.

6. The ceiling fan blade assembly as claimed in claim 5 further comprising a bolt extending through said blade bracket and contacting said frame.

* * * * *